US008915662B2

(12) United States Patent
Kildevaeld

(10) Patent No.: US 8,915,662 B2
(45) Date of Patent: Dec. 23, 2014

(54) MARKING BLADE

(71) Applicant: Michael Kildevaeld, Yarmouth Port, MA (US)

(72) Inventor: Michael Kildevaeld, Yarmouth Port, MA (US)

( * ) Notice: Subject to any disclaimer, the term of this patent is extended or adjusted under 35 U.S.C. 154(b) by 0 days.

(21) Appl. No.: 13/835,920

(22) Filed: Mar. 15, 2013

(65) Prior Publication Data

US 2013/0333232 A1 Dec. 19, 2013

Related U.S. Application Data

(60) Provisional application No. 61/660,715, filed on Jun. 16, 2012, provisional application No. 61/664,049, filed on Jun. 25, 2012, provisional application No. 61/714,172, filed on Oct. 15, 2012, provisional application No. 61/714,885, filed on Oct. 17, 2012.

(51) Int. Cl.

| | |
|---|---|
| ***A47L 1/08*** | (2006.01) |
| ***B25H 7/04*** | (2006.01) |
| ***B25H 7/02*** | (2006.01) |

(52) U.S. Cl.

CPC . *B25H 7/045* (2013.01); *B25H 7/02* (2013.01)
USPC ..... 401/25; 401/49; 401/88; 401/98

(58) Field of Classification Search

USPC ..... 401/19, 25, 49, 88, 198, 199; 30/346.61
See application file for complete search history.

(56) References Cited

U.S. PATENT DOCUMENTS

| | | | | |
|---|---|---|---|---|
| 2,261,314 | A * | 11/1941 | Vogel | 401/93 |
| 2,269,005 | A * | 1/1942 | Chaikin | 401/50 |
| 2,338,068 | A * | 12/1943 | Harris et al. | 401/75 |
| 3,141,187 | A * | 7/1964 | Simon, Jr. et al. | 401/199 |
| 3,231,924 | A * | 2/1966 | Lofgren | 401/198 |
| 3,639,070 | A * | 2/1972 | Davidson | 401/199 |
| 3,814,526 | A * | 6/1974 | Lotfallah | 401/199 |
| 6,059,477 | A * | 5/2000 | Dunlap et al. | 401/199 |
| 6,845,561 | B2 * | 1/2005 | Timson | 30/125 |
| 6,942,410 | B1 * | 9/2005 | Drewnoski | 401/50 |

(Continued)

OTHER PUBLICATIONS

International Search Report and Written Opinion for International Application No. PCT/US13/64651 dated Dec. 2, 2013, 9 pages.

*Primary Examiner* — John K Fristoe, Jr.
*Assistant Examiner* — Jennifer C Chiang
(74) *Attorney, Agent, or Firm* — Finnegan, Henderson, Farabow, Garrett & Dunner, LLP

(57) ABSTRACT

The present disclosure is directed towards the design of a marking device for writing or drawing on a given surface. The marking device can be made of any material that leaves a residue or makes legible marks on a surface brought into contact with the device. The marking device of the present disclosure can be used to make precise lines or shapes on any material, including rough surfaces, such as, wood, concrete, drywall, tiles, etc. The marking device can consistently produce thin lines without needing any sharpening. The marking device can be attached to a support frame, which can serves as a handle for grasping and using the marking device. The support frame can further provide a housing to shield the marking device from damage when not in use. In one exemplary embodiment, the marking device is shaped as a razorblade and is configured to fit into any standard utility knife. In such an embodiment, the utility knife serves as the support frame for the marking device. Such an arrangement allows a utility knife to be reversibly converted into a carpenter pencil.

17 Claims, 10 Drawing Sheets

(56) References Cited

U.S. PATENT DOCUMENTS

| | | | | |
|---|---|---|---|---|
| D579,045 | S | 10/2008 | Allemand | |
| D579,046 | S | 10/2008 | Allemand | |
| 7,645,083 | B2 | 1/2010 | Burry et al. | |
| 8,303,202 | B1 * | 11/2012 | Garcia | 401/52 |
| 2005/0150116 | A1 * | 7/2005 | Johnson et al. | 30/162 |

* cited by examiner

MARKING BLADE

This application claims priority to U.S. Provisional Application Nos. 61/660,715, filed Jun. 16, 2012; 61/664,049, filed Jun. 25, 2012; 61/714,172, filed Oct. 15, 2012; and 61/714,885, filed Oct. 17, 2012, all of which are incorporated herein by reference in their entirety.

The present disclosure relates generally to razorblades that can be used as marking tools, and more specifically, to the design of razorblades that can be used with standard utility knives for writing or drawing on various materials.

Carpenters, builders, designers, contractors, and tradesmen in general regularly use carpenter pencils to draw or make legible marks on a variety of materials. Carpenter pencils generally have a rectangular or elliptical cross-section, which allows thick or thin lines to be drawn by rotating the pencil. The lead of a carpenter pencil has to be strong enough to withstand the stress of making marks on rough surfaces; at the same time, the lead has to be thin on at least one side to make precise lines that can be followed with a saw blade or any other cutting/sculpting tool. Wood-encased carpenter pencils also have to be frequently sharpened in order to make thin, accurate lines. The sharpening is typically done with a knife to trim the wood around the pencil lead, followed by polishing the pencil lead with a sandpaper to achieve a sharp edge. Sharpening can be avoided with mechanical carpenter pencils; however, mechanical pencils generally have other disadvantages, for example, their complex design makes it difficult to insert/retract the pencil leads; the jaws supporting the pencil lead causes it to break frequently under the stress of writing or drawing on rough surfaces; and further, the jaws often give way during use and cause the lead to slip into the body of the pencil. Moreover, carpenter pencils and other carpentry marking tools lack precision because they cannot be placed accurately against a straight drawing edge (e.g., a ruler or set squares) because of their non-round shape and bulky casing.

The present disclosure is directed towards the design of a marking device that can be used in place of a carpenter pencil to draw legible lines or shapes on various material, including rough surfaces, for example, concrete, wood, carpet, tiles, cardboard, drywall, stones, etc. The marking device of the present disclosure allows thin lines to be drawn without needing any sharpening or polishing. This provides a distinct advantage over wood-encased carpenter pencils, which have to be repeatedly sharpened, especially when writing or drawing on course surfaces that tend to wear out the pencil lead quickly. The marking device, on the other hand, can consistently provide a sharp edge, even when used on course surfaces. Further, the marking device provides a planar edge that can be aligned substantially perpendicular to a working surface and it can be placed accurately against a drawing tool to make straight and precise lines even on course surfaces. The marking device can be used for drawing lines or shapes that can serve as guides in cutting or sculpting the material. The marking device can also be used for writing dimensions or other instructions on a piece of working material.

The marking device of the present disclosure is designed for use with a support frame, which is configured to house at least a portion of the marking device therein. Such an arrangement protects the marking device from damage when not in use. The support frame also provides a handle for grasping and using the device. The support frame has a user-friendly design, which allows for swift and easy mounting of the marking device on and off the frame.

A first embodiment of the present disclosure is a marking blade. The marking blade comprises a planar razorblade having a longitudinally extending marking edge. At least a portion of the marking edge comprises a marking material that makes legible marks on various surfaces.

A second embodiment of the present disclosure is another marking blade, which comprises a thin plate configured as a razorblade. The thin plate includes a longitudinally extending marking edge, and at least a portion of the marking edge comprises a pocket configured to a house a marking tip. The marking tip comprises a marking material that makes legible marks on various surfaces.

A third embodiment of the present disclosure is a marking device comprising a thin planar plate configured as a razorblade, and a support frame comprising a proximal end and a distal end. The proximal end of the support frame comprises a handle for grasping the support frame, and the distal end comprises a casing having a positioning member. The thin planar plate of the marking device comprises a longitudinally extending marking edge, and at least a portion of the marking edge comprises a marking material that makes legible marks on various surfaces. At least a portion of the thin planar plate comprises one or more alignment structures configured to attach to the positioning member of the casing.

The accompanying drawings, which are incorporated in and constitute a part of this specification, illustrate embodiments of the invention and together with the description, serve to explain the principles of the various aspects of the invention.

It is to be understood that both the foregoing general description and the following detailed description are exemplary and explanatory only and are not restrictive of the invention, as claimed.

DESCRIPTION OF EXEMPLARY EMBODIMENTS

Reference will now be made to certain embodiments consistent with the present disclosure, examples of which are illustrated in the accompanying drawings. Wherever possible, the same reference numbers are used throughout the drawings to refer to the same or like parts.

In this application, the use of the singular includes the plural unless specifically stated otherwise. Also, the use of "or" means "and/or" unless stated otherwise. Furthermore, the use of the term "including", as well as other forms, such as "includes" and "included," is not limiting. The section headings used herein are for organizational purposes only and are not to be construed as limiting the subject matter described.

Figure 1A:
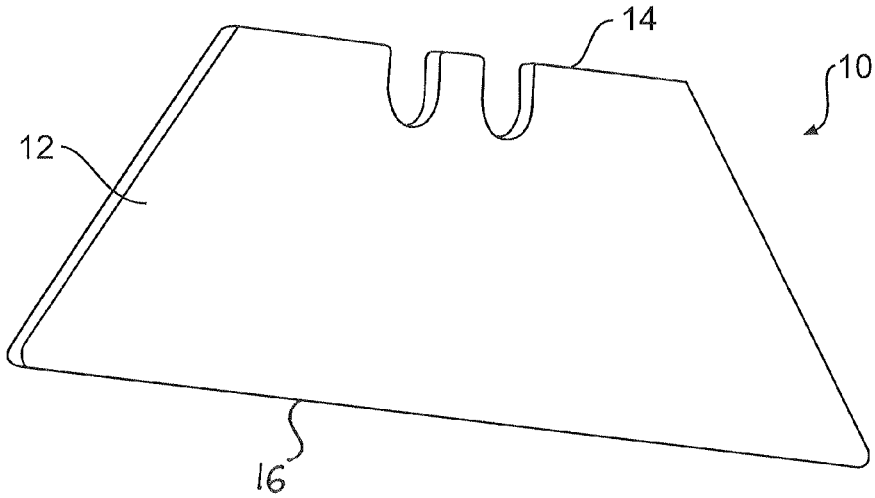
FIG. 1A illustrates the front view of a marking device, in accordance with exemplary embodiments of the present disclosure.
Figure 1B:
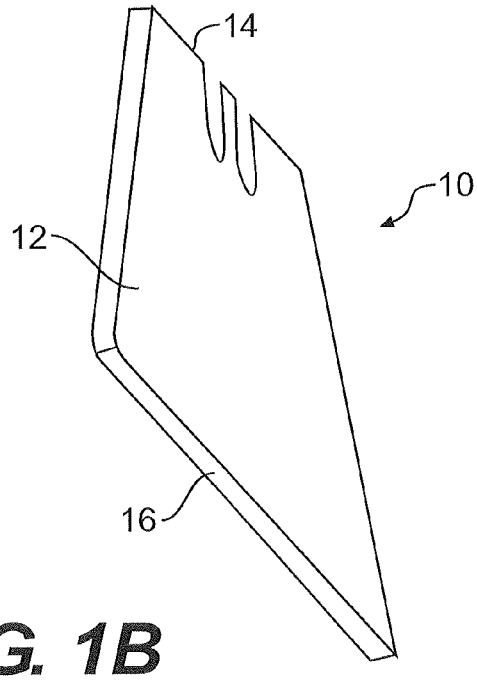
FIG. 1B illustrates a side perspective view of the marking device illustrated in FIG. 1A.
Figure 2A:
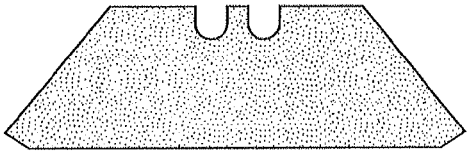
FIGS. 2A-2L illustrate various exemplary shapes of the marking device depicted in FIGS. 1A and 1B.
Figure 2B:
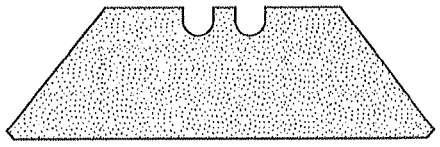
Figure 2C:
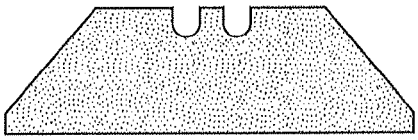
Figure 2D:
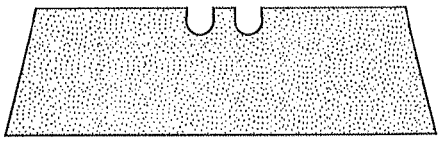
Figure 2E:
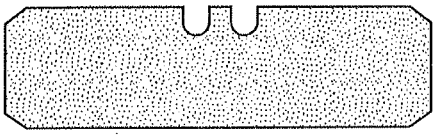
Figure 2F:
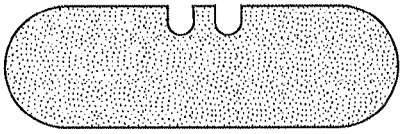
Figure 2G:
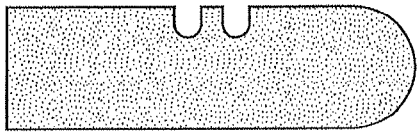
Figure 2H:
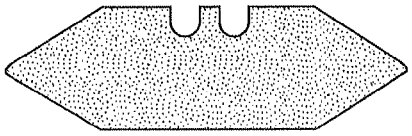
Figure 2I:
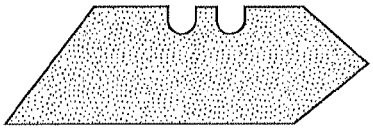
Figure 2J:
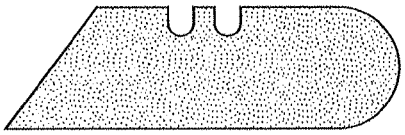
Figure 2K:
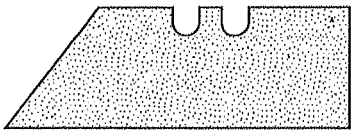
Figure 2L:
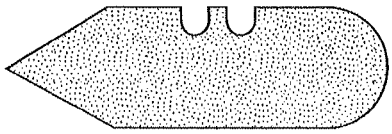

FIGS. 1A and 1B illustrate an exemplary marking device 10 for use in writing or drawing on different materials. Marking device 10 comprises a body 12 configured as a thin plate. Body 12 comprises a first longitudinal edge 14 and a second longitudinal edge 16, the latter of which is referred to hereinafter as the "marking edge." In some exemplary embodiments, marking device 10 is shaped as a quadrilateral (i.e., having four sides). The quadrilateral shape of marking device 10 can include, but is not limited to, square, rectangular, or trapezoidal shapes. In select embodiments, the corners of the quadrilateral-shaped marking device 10 are rounded or beveled, as depicted in FIGS. 2A-2L. In other exemplary embodiments, marking device 10 can have circular, oval, or semi-circular profile. In some embodiments, the shape of marking device 10 can be a combination of a quadrilateral on one side and an oval on the opposite side, as depicted, for instance, in FIG. 2G, FIG. 2J and FIG. 2L.

FIGS. 2A-2L illustrates the various exemplary shapes of marking device 10. The shapes illustrated in FIGS. 2A-2L are for representational purpose only, and are not intended to limit the various possible shapes of marking device 10.

In one exemplary embodiment, marking device 10 is shaped as a razorblade and is configured to fit into any standard utility knife. In such an embodiment, marking device 10 can be inserted into a utility knife in place of a regular razorblade. Such an arrangement can reversibly convert an ordinary utility knife into a carpenter pencil.

In one exemplary embodiment, marking device 10 has the same thickness throughout body 12. In another exemplary embodiment, the thickness of marking device 10 tapers gradually from the first longitudinal edge 14 to the marking edge 16. Marking edge 16 is configured to have a very small thickness in order to make thin, accurate lines. In exemplary embodiments, the thickness of marking edge 16 is in the range of about 0.025" to about 0.035".

At least a portion of marking device 10 is made of a marking material. The marking material comprises any substance that leaves a mark, stain, or residue on a given surface. The marking material can include, but is not limited to, graphite, chalk, clay, coloring dyes or pigments, day-glow ink, fluorescent ink, etc. The marking material may be a single material, or a composite of two or more marking materials. In exemplary embodiments, one or more marking materials are combined with a reinforcing material to increase the overall strength and/or rigidity of the marking material. In select embodiments, the marking material comprises one or more of a whitening agent, organic coloring pigment, talc filler, thermoset resin and thermoplastic resin.

Figure 3A:
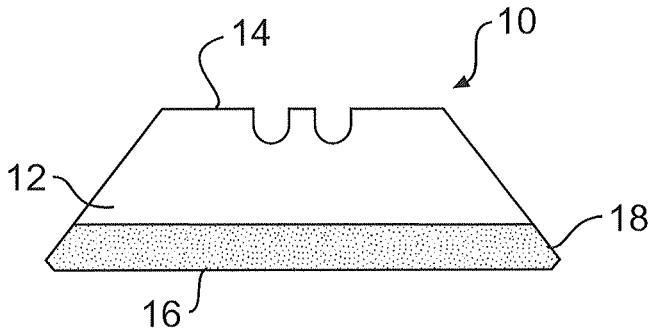
FIGS. 3A-3C illustrate various possible locations of marking material on a marking device, in accordance with exemplary embodiments of the present disclosure.
Figure 3B:
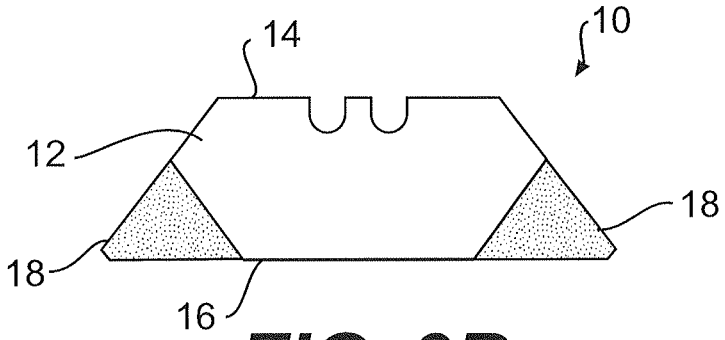
Figure 3C:
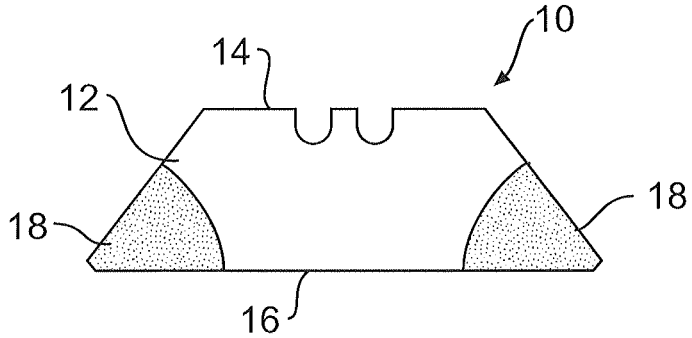

In select embodiments, the entire marking device 10 is made of the marking material. In other embodiments, only marking regions 18 of the marking device include the marking material. For example, marking edge 16, or a portion thereof, may be made of the marking material, as illustrated in FIGS. 3A-3C. In such embodiments, the remaining body 12 may be made of a stronger material, such as, metal or plastic, to increase the overall strength, rigidity, or durability of the marking device. Marking regions 18 may be attached to the rest of body 12 with an adhesive or other bonding material. In select embodiments, marking regions 18 are formed using an over-molding process. Prior to over-molding, marking regions 18 are made thinner than the rest of the marking device. Marking device 10 is then inserted into a mold and marking regions 18 are over-molded with the marking material.

Figure 4A:
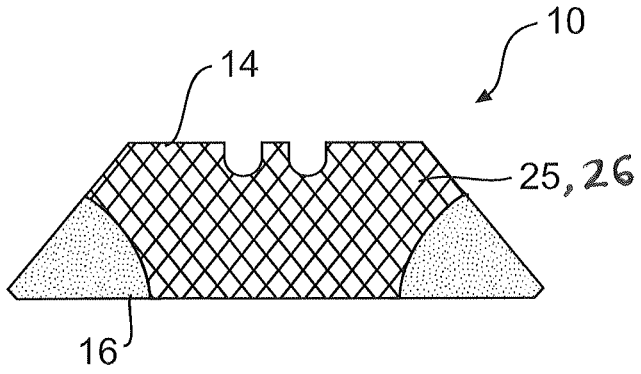
FIGS. 4A-4C illustrate various possible configurations of overlays or reinforcement inserts on a marking device, in accordance with exemplary embodiments of the present disclosure.
Figure 4B:
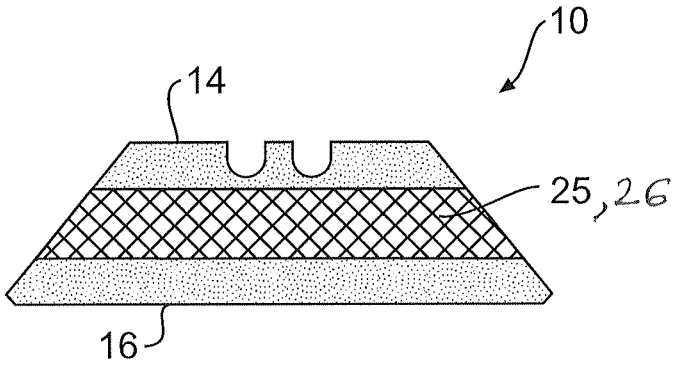
Figure 4C:
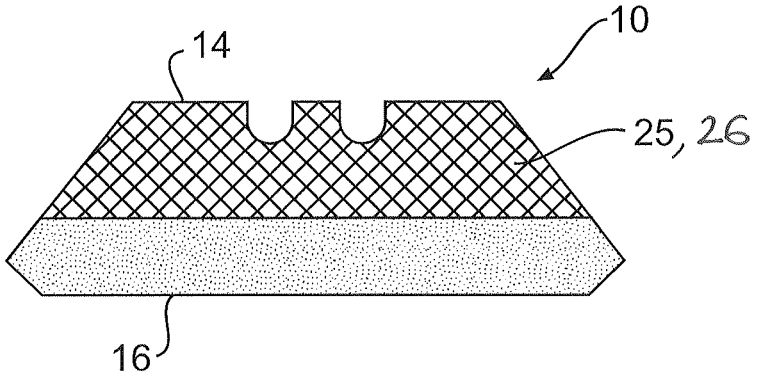

In certain embodiments, marking device 10 is partially draped or encased with one or more overlays 25 to reinforce the marking device and increase its durability. Overlays 25 may be provided on one or both sides of the marking device. In addition to providing reinforcement, overlays 25 may also be used to print or etch a brand name onto the device. In some exemplary embodiments, a reinforcement insert 26 is embedded within marking device 10. In such an embodiment, the reinforcement insert may be clad or encased with the marking material to form marking device 10. FIGS. 4A-4C illustrate the various possible configurations of overlays 25 or reinforcement insert 26 on marking device 10.

Figure 5A:
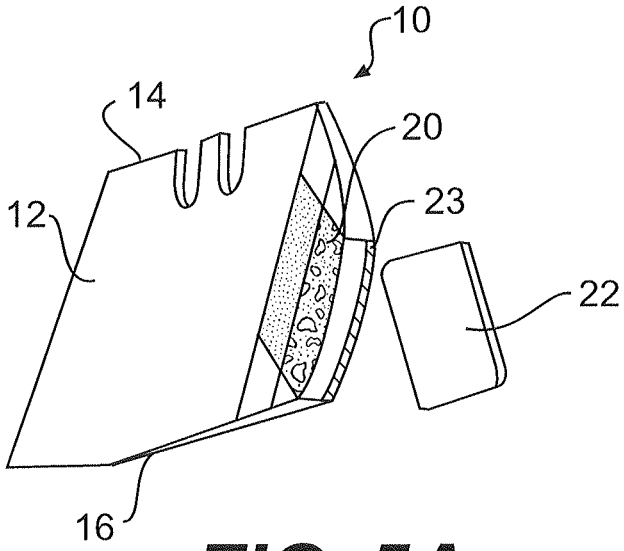
FIGS. 5A and 5B illustrate marking devices comprising one or more pockets for mounting marking members therein, in accordance with exemplary embodiments of the present disclosure.
Figure 5B:
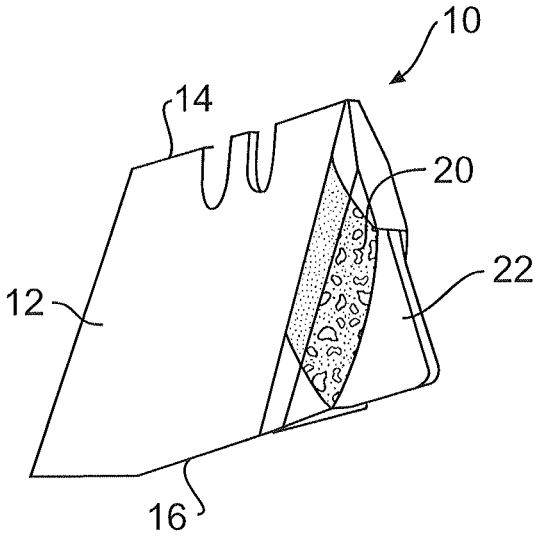
Figure 6A:
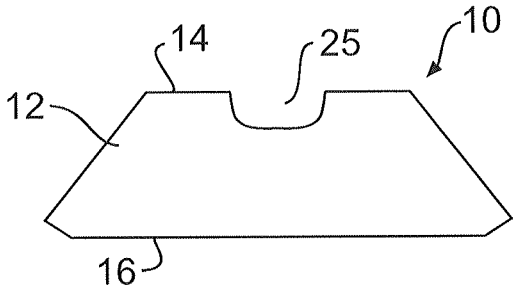
FIGS. 6A-6D illustrate various configurations of cut-outs or notches that may be formed on a longitudinal edge of a marking device, in accordance with exemplary embodiments of the present disclosure.
Figure 6B:
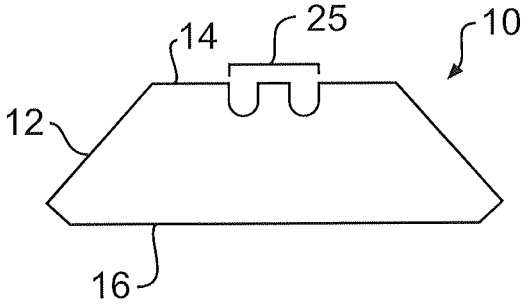
Figure 6C:
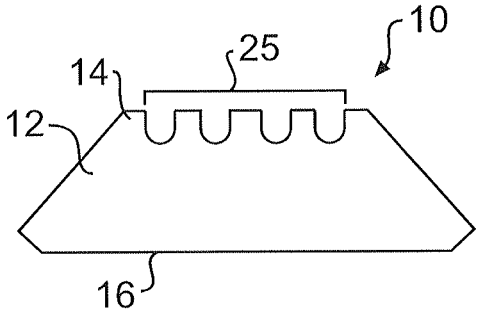
Figure 6D:
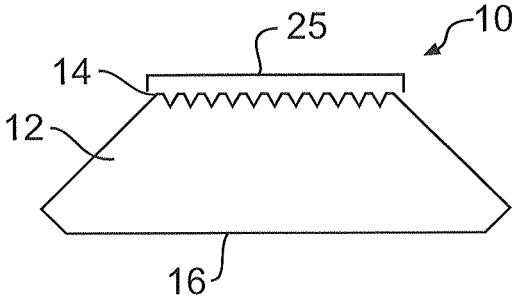

In some exemplary embodiments, as illustrated in FIGS. 5A and 5B, marking device 10 comprises a pocket 20 for mounting a marking member 22. In such embodiments, body 12 of marking device 10, including pocket 20, is made of plastic or metal (for example, stainless steel), and the marking member 22 is made of a marking material described earlier in this disclosure. Pocket 20 can be positioned anywhere along marking edge 16, or at one or more corners of marking device 10. In one such embodiment, illustrated in FIG. 5A, pocket 20 comprises an extended flap 23, which helps to guide the marking member 22 into the pocket. In another embodiment, pocket 20 comprises a spring-loaded tab to firmly secure marking member 22 in the pocket. FIG. 5B illustrates marking device 10 with marking member 22 mounted into pocket 20. In such embodiments, only the marking member 22 has to be replaced when it wears out without having to dispose the entire marking device 10. In select embodiments, marking member 22 is double edged, i.e., marking member 22 can be flipped around when one edge wears out, and thereby, the marking member can be used longer without requiring a replacement.

Figure 7A:
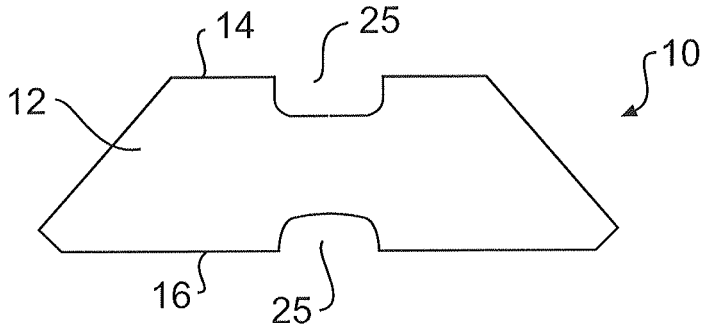
FIGS. 7A-7C illustrate various configurations of cut-outs or notches that may be formed along two edges of a marking device, in accordance with exemplary embodiments of the present disclosure.
Figure 7B:
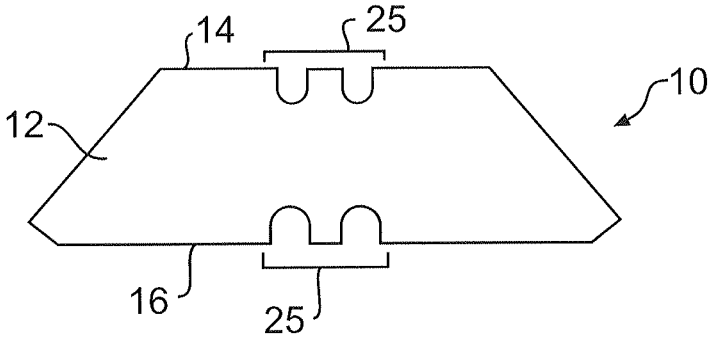
Figure 7C:
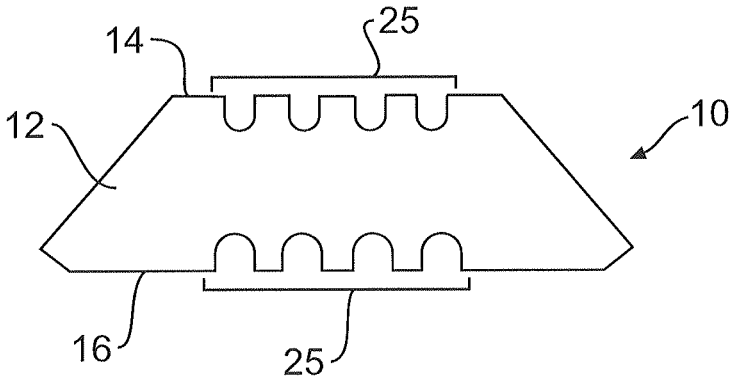
Figure 8A:
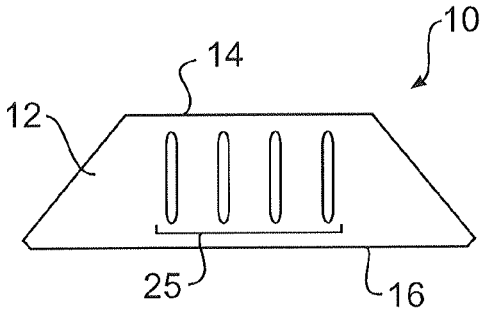
FIGS. 8A-8C illustrate various configurations of cut-outs or notches that may be formed in the center of a marking device, in accordance with exemplary embodiments of the present disclosure.
Figure 8B:
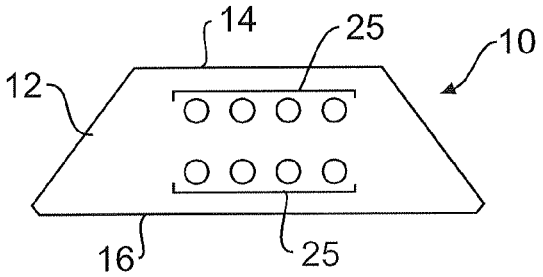
Figure 8C:
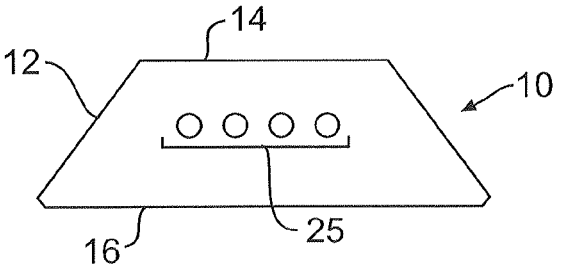

In illustrative embodiments, marking device 10 is configured to be mounted on a support frame 30. In some embodiments, edge 14 of the marking device comprises one or more cut-outs, notches, indentations, or alignment tabs configured to connect to corresponding structures or positioning members on support frame 30. FIGS. 6A-6D illustrate various cut-outs/notches 25 formed on edge 14 of the marking device to connect it to support frame 30. In certain embodiments, cut-outs/notches 25 are formed on both edge 14 and marking edge 16, as depicted in FIGS. 7A-7C. In other embodiments, the cut-outs/notches 25 or other alignment features are positioned in the center portion of marking device 10, as illustrated in FIGS. 8A-8C.

In select embodiments, support frame 30 along with marking device 10 is disposable. In other embodiments, support frame 30 is reusable. In such embodiments, when marking device 10 wears out, it can be swapped with a replacement marking device 10.

In exemplary embodiments, support frame 30 comprises a proximal end 32 and a distal end 34. Distal end 34 is configured to mount marking device 10, and the proximal end 32 is configured as a handle that may be gripped by an user while using the marking device. In one embodiment, distal end 34 comprises a safety casing configured to house marking device 10 when not in use. Marking device 10 can be pushed or folded out of the casing when needed to draw or write on a surface. In such embodiments, proximal end 32 may comprise a manual switch (for example, a thumb slider) that triggers an activation mechanism to push or slide marking device 10 out of the safety casing. Alternatively, the switch/trigger for pushing or sliding the marking device out may be positioned anywhere on support frame 30. When not in use, the marking device 10 can be retracted back into the safety casing. For example, marking device 10 may be automatically retracted into the safety casing when the switch/trigger on the proximal end 32 is released. Such an arrangement shields marking device 10 from damage. In another embodiment, distal end 34 is simply configured to fasten marking device 10 without providing a safety casing. Such an embodiment may comprise a removable cap or a guard to shield marking device 10 when not in use.

In illustrative embodiments, marking device 10 has the same dimensions as that of a conventional razorblade and is adapted to fit a retractable or folding utility knife (for example, a STANLEY knife). In such embodiments, the utility knife serves as support frame 30. In select embodiments, marking device 10 is a combination of a conventional razorblade on one side for use in cutting/sculpting, and a marking tool on the opposite side for drawing or writing. The combination blade may be used with the utility knife.

Figure 9:
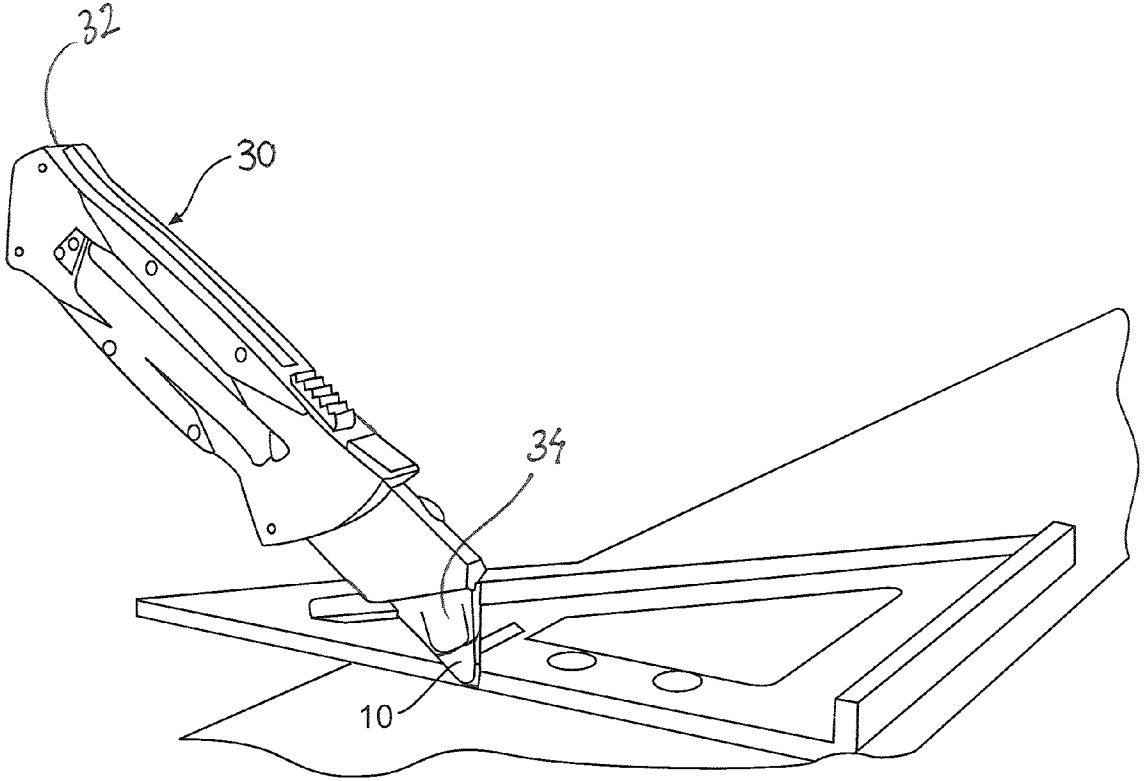
FIG. 9 illustrates a marking device mounted on a utility knife, in accordance with exemplary embodiments of the present disclosure.

FIG. 9 illustrates marking device 10 mounted on a support frame/utility knife 30. In exemplary embodiments, the razorblade-shaped marking device 10 has an average thickness of about 0.025" to about 0.035", length of about 2.425" and the height ranges from about 0.735" to about 0.75". In exemplary embodiments, marking edge 16 is razor-thin, and thus, it allows precise lines to be made on any given surface. In one such embodiment, the thickness of the lines made by marking device 10 is about 0.025" to about 0.035".

Figure 10A:
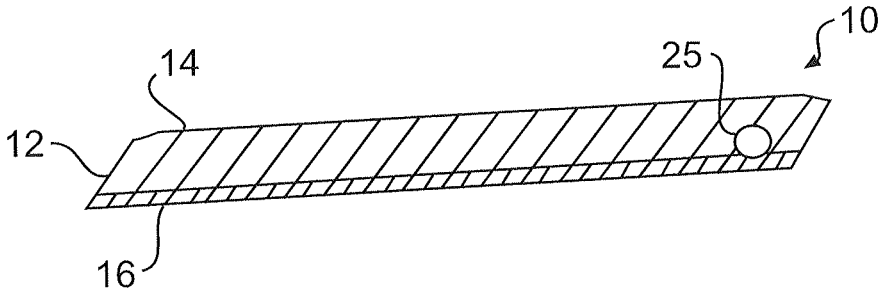
FIG. 10A illustrates a snap-off marking blade, in accordance with exemplary embodiments of the present disclosure.
Figure 10B:
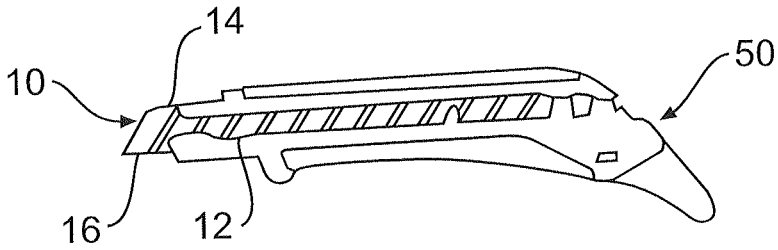
FIG. 10B illustrates a snap-off marking blade mounted on a snap-off utility knife, in accordance with exemplary embodiments of the present disclosure.

In select embodiments, marking device 10 is in the form of a snap-off razorblade configured to fit a snap-off utility knife 50. FIG. 10A illustrates a snap-off marking device 10, and FIG. 10B illustrates a snap-off marking device 10 mounted on a snap-off utility knife 50. The blade sections of a snap-off marking device 10 can be broken to release fresh, sharp marking edge 16. The blade can be retracted for safe storage when not in use. In some embodiments, snap-off marking device 10 is a solid planar blade, i.e., without the snap-off portions, and is configured to be mounted on a snap-off utility blade.

By configuring marking device 10 as a razorblade, a utility knife can be converted into a carpenter pencil as and when required. Such an arrangement has several advantages over standard carpenter pencils. For instance, a utility knife is easier to grip than a carpenter pencil, and also, utility knife is a common tool already used by carpenters, builders, contractors, and tradesmen in general. The razorblade of the utility knife can be easily swapped with marking device 10 to generate a carpenter pencil. Once mounted onto a utility knife, marking device 10 is easily protected from damage in the workplace environment, for example, when placed in a bag together with heavy tools.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. A marking blade, comprising:

a marking device having a longitudinally extending marking edge, wherein at least a portion of the marking edge comprises a marking material that makes legible marks on various surfaces, and wherein the marking device comprises one or more cut-outs or notches configured to receive an alignment tab or positioning member of a support frame;

wherein the marking device has a snap-off razorblade shape and is further configured to have portions thereof snapped-off at substantially regular intervals.

2. A marking blade, comprising:

a thin plate configured as a razorblade, the thin plate having a longitudinally extending marking edge; and wherein at least a portion of the marking edge comprises a pocket configured to a house a marking tip, the marking tip comprising a marking material that makes legible marks on different surfaces.

3. The marking blade of claim 2, wherein the marking material is graphite.

4. The marking blade of claim 2, wherein the marking material is a combination of clay and graphite.

5. The marking blade of claim 2, wherein the marking material comprises a coloring dye or pigment.

6. The marking blade of claim 2, wherein the marking tip is double edged.

7. The marking blade of claim 2, wherein the razorblade comprises one or more cut-outs or notches configured to receive an alignment tab or positioning member of a support frame.

8. The marking blade of claim 7, wherein the support frame is a utility knife.

9. A marking device, comprising:

a thin planar plate configured as a razorblade, the plate having a longitudinally extending marking edge, and wherein at least a portion of the marking edge comprises a marking material that makes legible marks on various surfaces;

a support frame having a proximal end and a distal end, wherein the proximal end comprises a handle for grasping the support frame, and the distal end comprises a casing having a positioning member;

further wherein at least a portion of the plate comprises one or more alignment structures configured to attach to the positioning member of the casing.

10. The marking device of claim 9, wherein the support frame is a utility knife.

11. The marking device of claim 10, wherein the plate is a snap-off razorblade and the utility knife is a snap-off utility knife.

12. The marking device of claim 9, wherein the marking material comprises graphite, clay, coloring pigment, chalk, ink, or combinations thereof.

13. The marking device of claim 9, wherein the marking edge consistently produces lines having a thickness of about 0.025" to about 0.035".

14. The marking device of claim 9, wherein the marking edge comprises a pocket configured to hold the marking material.

15. The marking device of claim 9, wherein the casing houses at least a portion of the plate when not in use.

16. The marking device of claim 15, wherein the plate is folded or pushed out of the casing when an activation mechanism is triggered.

17. The marking device of claim 9, wherein the support frame is configured to enable the marking device to be placed perpendicular to the surface during writing or drawing.

* * * * *